United States Patent [19]

Roeder et al.

[11] 4,338,602

[45] Jul. 6, 1982

[54] SEMI-ACTIVE GUIDANCE SYSTEM

[75] Inventors: Robert S. Roeder; W. Baldwin Day, both of Dunedin; Harold W. Hunt; Robert E. Wilt, both of Clearwater, all of Fla.

[73] Assignee: Sperry Corporation, New York, N.Y.

[21] Appl. No.: 171,560

[22] Filed: Jul. 23, 1980

Related U.S. Application Data

[63] Continuation of Ser. No. 947,975, Oct. 2, 1978, abandoned.

[51] Int. Cl.[3] ..... G01S 13/08

[52] U.S. Cl. ..... 343/10; 343/5 R; 343/5 SW; 343/7.5; 343/14; 343/100 LE; 343/100 ME

[58] Field of Search ..... 343/5 R, 5 SW, 10, 7.5, 343/14, 100 PE, 100 ME, 100 LE

[56] References Cited

U.S. PATENT DOCUMENTS

| | | | |
|---|---|---|---|
| 3,094,695 | 6/1963 | Jahn | 343/100 LE |
| 3,643,256 | 2/1972 | Owen | 343/100 LE |
| 3,875,569 | 4/1975 | Hill et al. | 343/5 R |
| 3,921,169 | 11/1975 | Lazarchik et al. | 343/5 R |
| 4,156,874 | 5/1979 | Kopis | 343/100 PE |

*Primary Examiner*—S. C. Buczinski

*Attorney, Agent, or Firm*—Howard P. Terry; Seymour Levine

[57] ABSTRACT

An air-to-ground tracking guidance system wherein a tracker/illuminator and a terminally guided seeker are utilized. Target track is initially established by the tracker/illuminator which also provides a target illuminating signal. Semi-active tracking utilizing the reflected target illuminating signal is employed by the seeker after launch. During this period of operation, the seeker is prevented from tracking the tracker/illuminator by means of a unique guard radiation system. The semi-active mode is supplemented by an active mode in which the seeker tracks reflections of a target illumination signal emitted therefrom and a passive mode during which the seeker tracks the radiometric thermal emission from the target. While in the semi-active mode, the seeker establishes a range track that is independent of the semi-active mode of operation. This permits the seeker to automatically convert the mode of operation to active and passive at the desired positions along the seeker's track.

7 Claims, 5 Drawing Figures

SEMI-ACTIVE GUIDANCE SYSTEM

This application is a continuation division of application Ser. No. 947,975, filed Oct. 2, 1978, now abandoned.

BACKGROUND OF THE INVENTION

1. Field of the Invention

This invention pertains to air-to-ground tracking and guidance systems and more particularly to an air-to-ground tracking and guidance system utilizing an illuminator/tracker and a tri-mode terminally guided seeker.

2. Description of the Prior Art

Previous air-to-ground terminal guidance seekers principally used autonomous dual mode (active/passive) seekers for weapons delivered in either a ballistic trajectory delivery or in a near horizontal trajectory. These systems were subsequently improved to include range measurement. A dual mode seeker system which incorporates this improvement is described by Lazarchik et al in U.S. Pat. No. 3,921,169 for a Multi-Mode Radiometric System with Range Detection Capability, issued Nov. 18, 1975 and assigned to Sperry Rand Corporation. The tracking capabilities of these systems have been enhanced with improvements made in signal-to-clutter ratio and signal-to-receiver noise ratio by employing techniques such as linear FMCW and multiple narrow frequency range bins for automatic search acquisition and range and angle tracking. A system employing the narrow frequency range bin concept is described by Roeder et al. in U.S. Pat. No. 4,200,871, Acquisition System for Continuous Wave Modulation Object Detector.

Semi-active or bistatic systems have been extensively employed in two major areas: laser designation systems and surface-to-air radar missile systems. These systems incorporate an illuminator or designator which can single out a target and illuminate it with a signal which the seeker can identify and use for homing. The laser systems success is attributable to the directivity of the designating beam which permits laser energy to be concentrated within a small area to which the homing device is directed. Since laser systems operate with optical beams, they lose effectiveness when fog or smoke obscures the line of sight between the observer and the target.

Semi-active surface-to-air radar systems generally operate against airborne targets which are isolated in space. This condition allows a homing seeker to be accurately directed to the target, though the coverage area of the illuminating beam is appreciably broader than the extent of the target.

Semi-active homing has not been heretofore employed against ground targets because of the difficulty of confining the illuminating beam to a single target. The addition of active/passive autonomous homing to the initial semi-active homing as described herein provides an over-all homing system with appreciable capability for air-to-ground systems. This addition provides for the transition from semi-active to active to passive operation as the seeker approaches the target. Since the passive mode which normally seeks the centroid of the radiating area is employed to the final mission, a high accuracy long range system is realized.

SUMMARY OF THE INVENTION

The present invention relates to an air-to-ground guidance system which utilizes a tri-mode terminal guidance seeker and a separate tracker/illuminator. The three modes of seeker operation are: a semi-active mode during which the seeker tracks the reflected illumination signal from a target illuminated by the tracker/illuminator; an active mode during which the seeker illuminates the target and tracks the signal reflected therefrom; and a passive mode during which the seeker tracks a radiometric thermal emission from the target.

Initial target acquisition is performed by an acquisition radar which then provides the target illumination for the semi-active mode of seeker operation. During the semi-active mode of operation, the seeker identifies and rejects direct signals from the illuminator while it acquires and angularly tracks the reflected illuminator signal from the target area and independently establishes a range track of the terrain background which permits the seeker to measure its range to go for subsequent automatic mode changes from semi-active tracking, to active tracking, and subsequently to passive terminal tracking. This mode sequence is not mandatory. The seeker may operate in a totally autonomous mode if the illumination signal is not present, automatically searching, acquiring and tracking a target by utilizing the self-contained active and passive modes.

DESCRIPTION OF THE PREFERRED EMBODIMENTS

Figure 1:
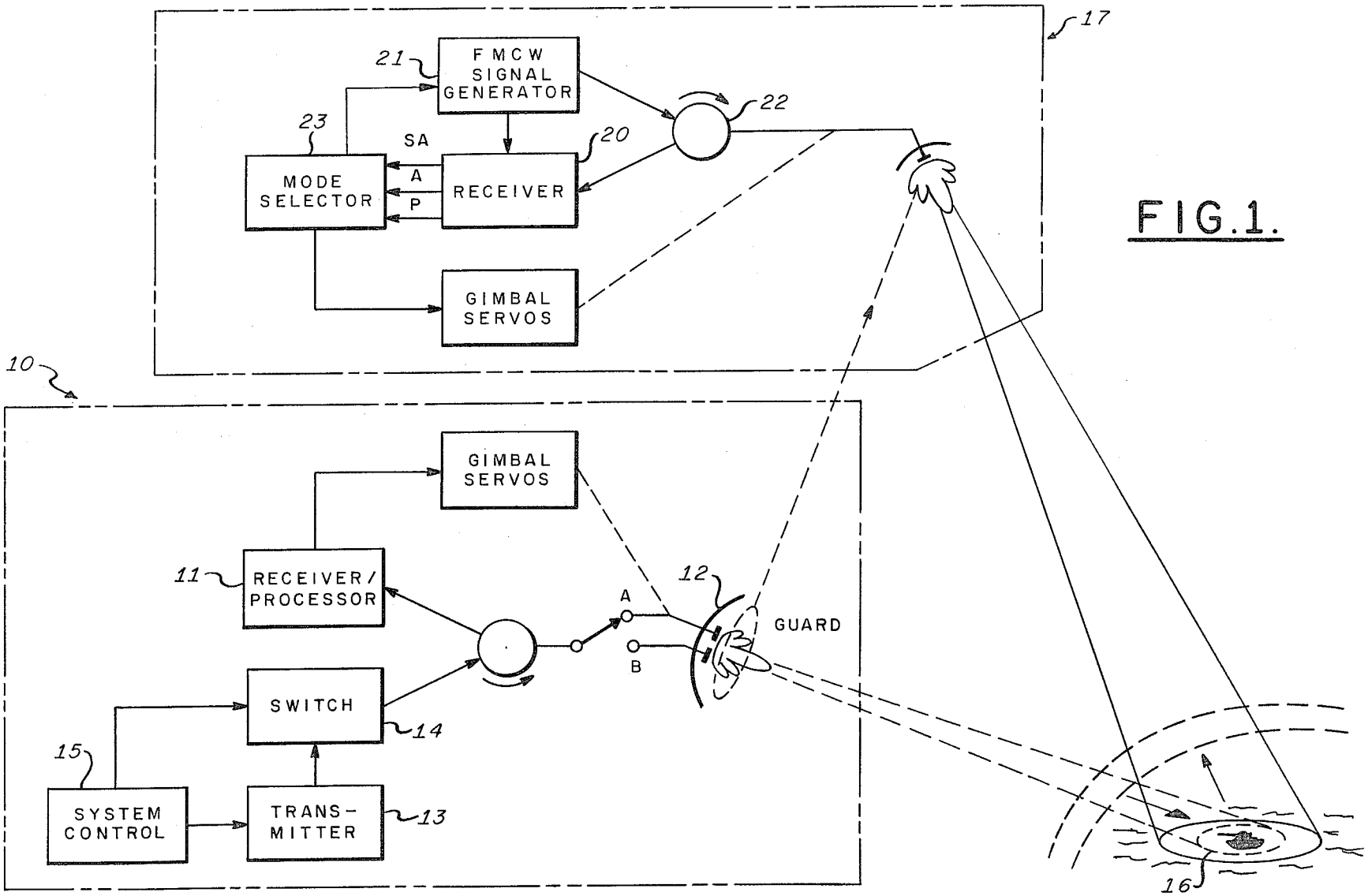
FIG. 1 is a block diagram of the system applicable during the semi-active mode of operation.

Refer to FIG. 1, wherein a block diagram of the semi-active mode of system operation is presented. A tracker/illuminator 10 for this mode may comprise a conventional monopulse radar receiver 11, a monopulse antenna 12, modified for guard signal radiation, subsequently to be described, which minimizes the probability of the seeker acquiring and tracking the tracker/illuminator 10, a transmitter 13, a switch 14, and a system control unit 15. Initial target acquisition and track is accomplished with the monopulse radar. The sum beam of the monopulse antenna 12 which illuminates the target 16 is reflected therefrom towards the tracker/illuminator 10 and the seeker 17, which may comprise a seeker receiver 20, a frequency modulated continuous wave signal generator 21, circulator 22 and a mode selector 23.

The transmitter 13 of the tracker/illuminator 10 is caused to alternately transmit an illuminator signal with a frequency $f_1$ and a guard signal with a frequency $f_2$ by the system control 15, which simultaneously controls a switch 14 causing antenna 12 to alternate between illuminator and guard radiation patterns. These patterns differ appreciably, with the guard pattern exhibiting greater gain over all space than does the illuminator pattern, except within the angular region of the illuminator patterns main beam. This may be accomplished by any number of well known methods, one of which is a dual feed parabolic antenna system with the feed for the guard signal radiation in a defocussed position.

During system operation, the seeker 17 searches for the reflected main beam illuminator pulse signals from the target. While performing this search, seeker 17 may receive signals over a direct path from the tracker/illuminator 10 radiated through the side lobes of the illuminator antenna pattern. The seeker 17 will also receive the signal radiated by the guard antenna pattern identifying it by its signal frequency. When the guard signal amplitude is greater than the amplitude of the received illuminator signal, an indication that the illuminator signal has been received over a direct path, the received illuminator signal is rejected by the system. Signals of the illuminator pattern reflected from the target 16 will be accepted since they arrive at a later time when the rejection, caused by the reception of the guard signal is no longer in effect. Illuminator main beam signal pulses and guard signal pulses received by the seeker 17 are coupled via circulator 22 to separate channels in seeker receiver 20, where they are processed to reject the direct signals from the tracker illuminator 10 and to activate the angular tracking loop in the seeker receiver 20.

Range tracking in the seeker 1, is provided by an active FMCW range tracker which comprises the FMCW signal generator 21 and a range tracking channel in receiver 20. This FMCW range tracker measures the range to the target and provides a range-to-go voltage to a mode selector 23 to process for mode switch over.

To prevent lock-on of the seeker 17 to the tracker/illuminator 10, should the main beam of the radiation pattern of the seeker 17 and the tracker/illuminator 10 be pointed at one another, the radiation from the tracking illuminator 10 may be circularly polarized with a given sense of polarization and the receiving antenna of the seeker 17 may be circularly polarized with the opposite sense of polarization. Since the sense of circular polarization reverses when the signal is reflected, the seeker antenna accepts the reflected illuminator signal and rejects the direct illuminator signal.

Figure 2:
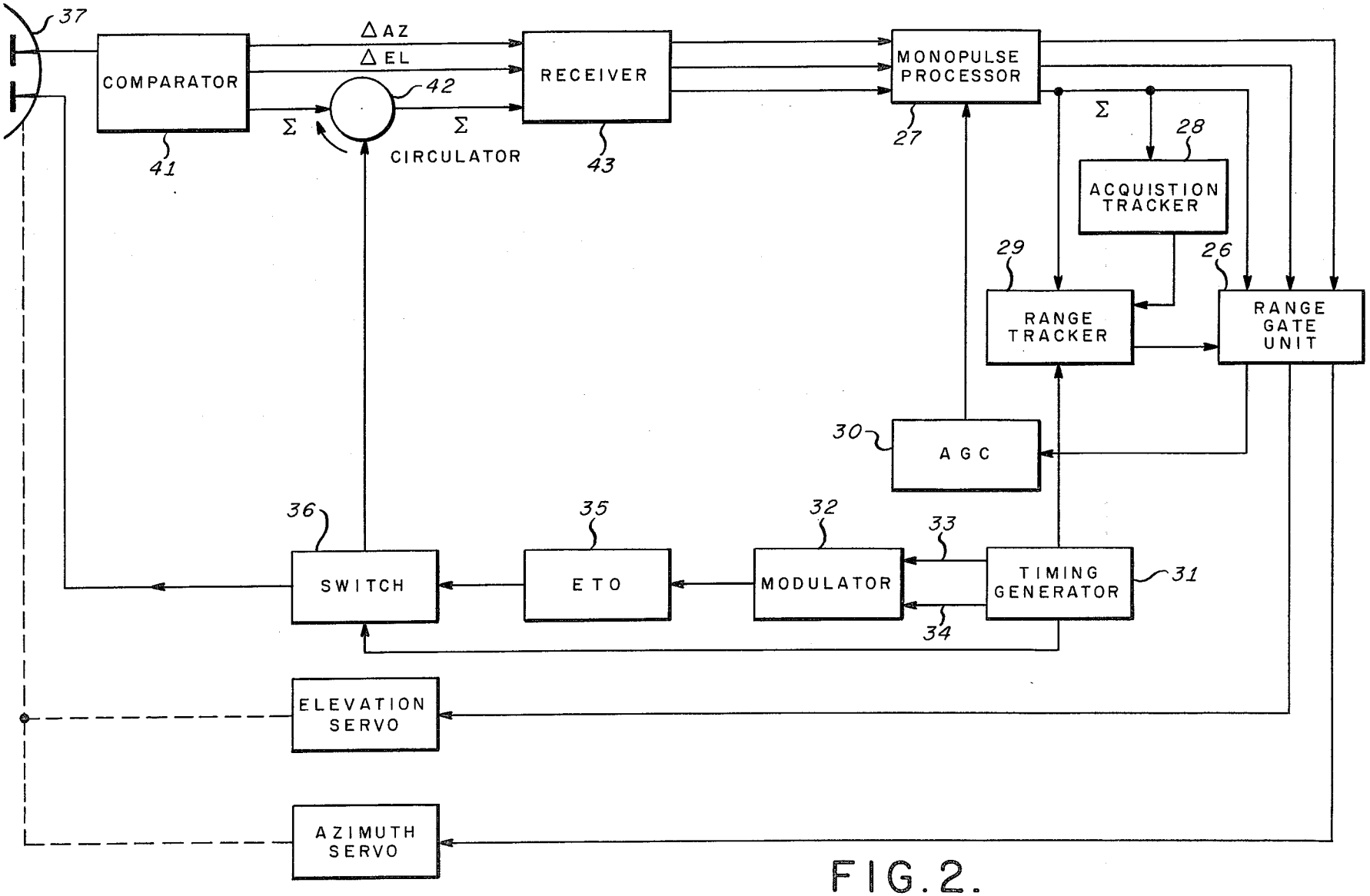
FIG. 2 is a block diagram of the tracker/illuminator.

The operation of the tracker/illuminator 10 will be explained with reference to FIG. 2. Initially, the range gates of range gate unit 26 are closed preventing angle tracking or AGC action. When a predetermined threshold is achieved in monopulse processor 27, the acquisition detector 28 enables the range tracker 29 which in turn activates range gates of range gate unit 26 and couples a signal therethrough to activate the AGC 30 which controls the gain of the monopulse processor 27. At the same time, signals are enabled to the azimuth and elevation servos. System timing is provided by timing generator 31 which couples synch pulses to the range tracker 29 and timing pulses to modulator 32 via lines 33 and 34 on an alternate basis. In response to these alternate pulses, the modulator 32 alternately couples pulses of different amplitudes to an electronically tunable oscillator (ETO) 35, causing ETO 35 to alternately oscillate at the illuminator frequency $f_1$ and the guard frequency $f_2$ thus providing the illuminator and guard power pulses. A switch 36, which is set by pulses from the timing oscillator 31 that occur between the pulses coupled to lines 33 and 34, alternately couples the illuminator power pulse and the guard power pulse to an antenna 37. Antenna 37 may provide a radiation pattern in response to the guard signal which has a gain which is greater than the radiation pattern provided in response to the illuminator signal at all spatial angles except in the angular region of the main lobe of the illuminator radiation pattern. Thus, at all points in space, excepting the angles included in the illuminator pattern main beam, more direct signal strength will be received from the guard pattern than from the illuminator pattern.

Modulator 32 will be described in more specific detail with reference to FIG. 3.

Figure 3:
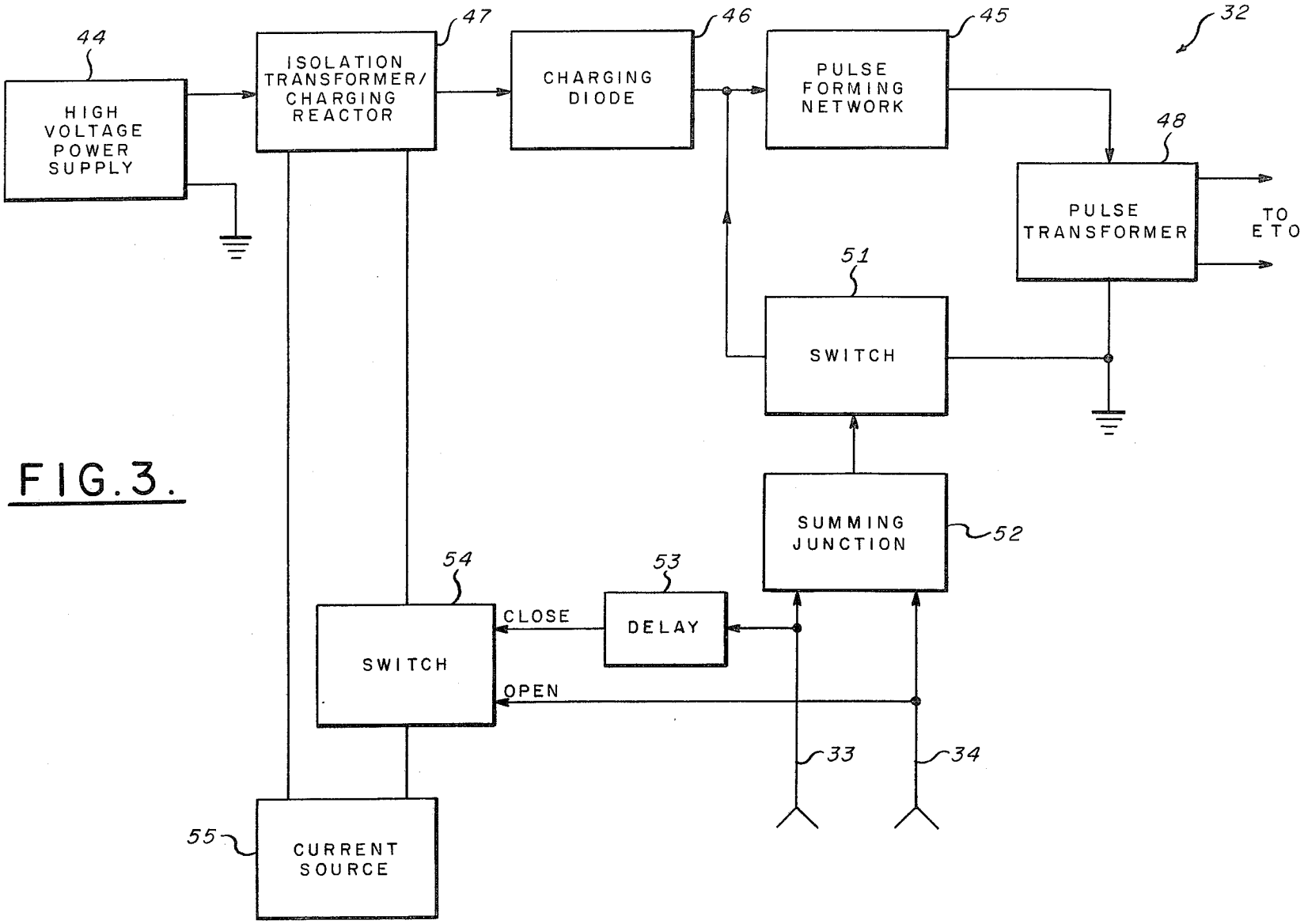
FIG. 3 is a block diagram of the modulator in FIG. 2.

As shown in FIG. 3, a modulator 32 may comprise a high voltage power supply 44 coupled to an input terminal of a pulse forming network 45 via a diode 46 and a reactor 47 with an output terminal of pulse forming network 45 coupled to a pulse transformer 48. A first switch 51, coupled at an input terminal to receive pulses from a summing junction 52, has its output terminal coupled to the junction of the input terminal of pulse forming network 45 and the output terminal of charging diode 46. A first input terminal of the summing junction 52 is coupled to the timing generator 31 of FIG. 2 via line 33 and through a delay network 53 to a terminal of a second switch 54, through which a current source 55 is coupled to isolation transformer/charging reactor 47, while a second input terminal of the summing junction 52 is coupled to the timing generator via line 34 and to a second terminal of the second switch 54.

In operation, second switch 54 is initially open and the high voltage power supply 44 charges the pulse forming network 45 through the diode 46 and the isolation transformer/charging reactor 47. A pulse applied to either input of the summing junction 52 causes switch 51 to close and provide a current pulse to ETO 35 of FIG. 2. Upon application of the $f_1$ timing pulse to summing network 52, which may appear on line 33, switch 51 closes, causing the pulse transforming network 45 to discharge through the pulse transformer 48 suddenly applying the energy stored in the pulse forming network 45 to the ETO 35 thereby producing the illuminator RF pulse at frequency $f_1$. When the pulse forming network 45 has been drained of its stored energy, switch 51 opens and the pulse forming network 45 recharges in preparation for the next trigger pulse. After a delay through delay circuit 53, the $f_1$ timing pulse is also applied to switch 54 causing it to close. Current from current source 55 then flows in the primary circuit of the isolation transformer/charging reactor 47 causing the transformer secondary (charging) voltage to be greater than it would be, were the high voltage power supply 44 to charge the pulse forming network 45 alone. Pulse forming network 45 therefore charges to a higher voltage. When the $f_2$ timing pulse is applied to summing network 52 via line 34, the pulse forming network 45 will discharge this higher voltage to ETO 35 thereby producing the guard RF pulse at frequency $f_2$. The $f_2$ timing pulse opens the second switch 54 and the sequence is repeated with the next pulse coupled to the summing junction 52 and delay circuit 53 from line 33.

Refer again to FIG. 2. Target tracking by the illuminator may be accomplished by means of a monopulse tracking system which is well known in the art. In such a system, illuminator power pulses may be coupled to antenna 37 via the sum channel of a hybrid comparator 41 and a circulator 42. Illuminator signals received by the sum channel of comparator 41 may be coupled to receiver 43 via circulator 42 while signals received via the difference channels of comparator 41 may be directly coupled to receiver 43. IF signals from receiver 43 may be fed to the monopulse processor 27 where video pulses related in amplitude and polarity to the angular errors in azimuth and elevation are generated.

Sum channel signals are also coupled to the acquisition detector 28 wherein the detected video is compared to the background clutter. When a pulse train with video signals of a predetermined amplitude above the clutter exists, the range tracker 29 is enabled and range tracking commences. Operation of the range tracker 29 produces gating pulses at the PRF which permit track error signal pulses and the sum signal video to pass through range gates in range gate unit 26. The range gated sum signal is then coupled to the AGC 30 where gain control signals for the monopulse processor 27 are produced.

Figure 4A:
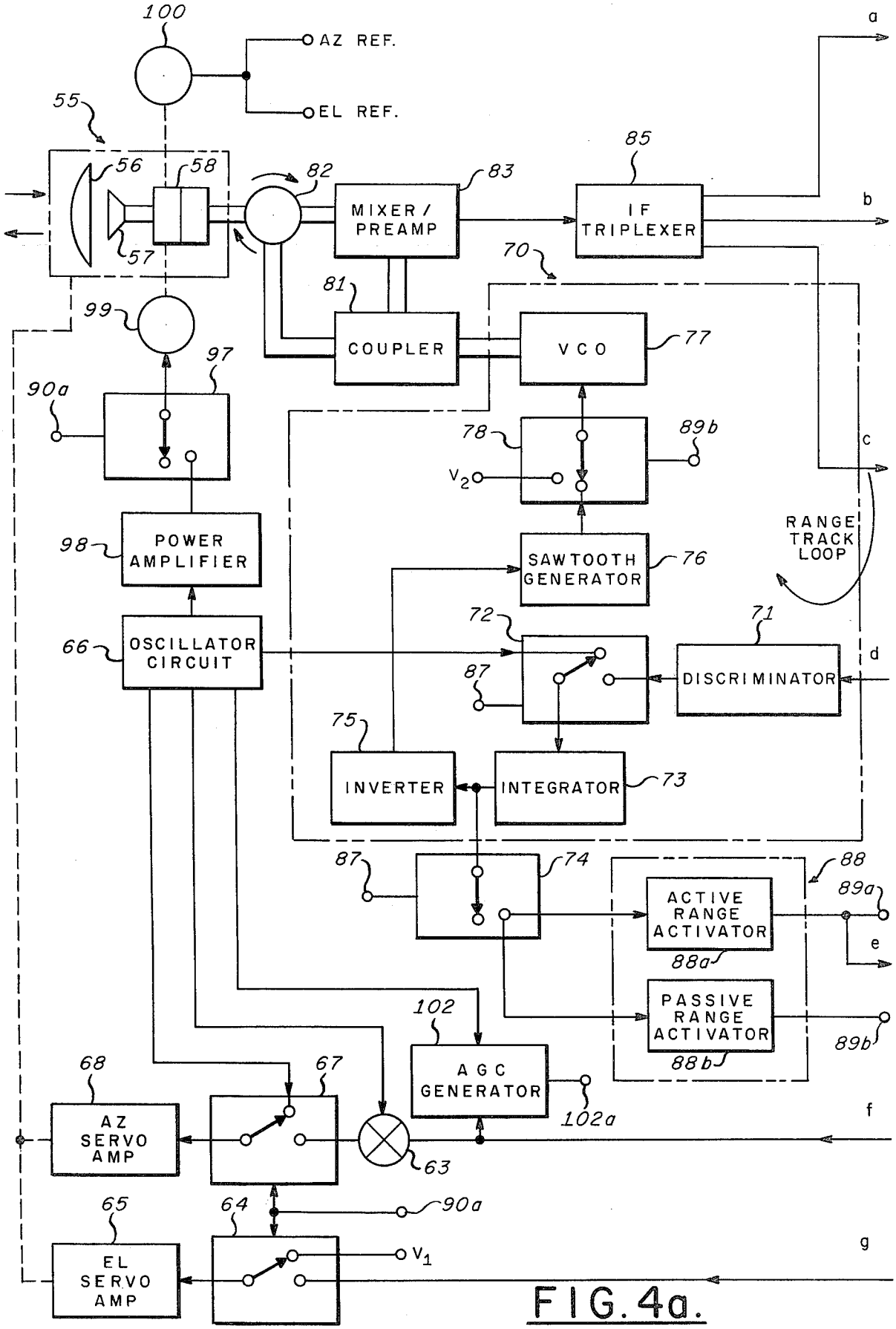
FIGS. 4*a–b* are block diagrams of the tri-mode seeker.
Figure 4B:
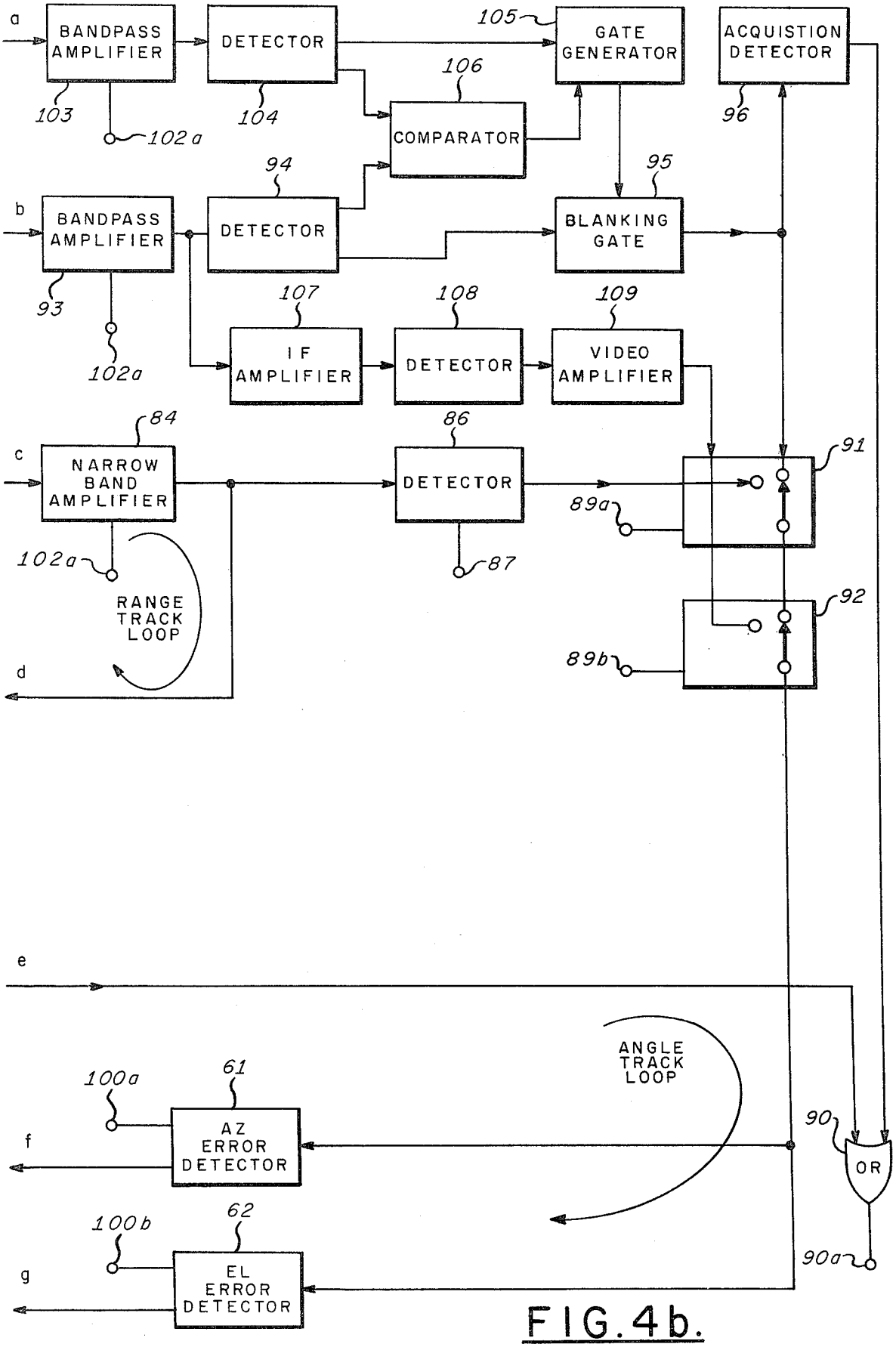

Operation of the seeker 17 in FIG. 1 will be explained with reference to FIG. 4. During operation, seeker 17 is initially searching in the semi-active mode with antenna 55 receiving illuminator signals reflected from the target 16 in FIG. 1. Antenna 55 may include a collimating lens 56 cooperating with an electromagnetic horn 57 which is coupled to a rotary joint 58. It will be recognized by those skilled in the art that the antenna 55 as illustrated in FIG. 4 represents only one of many configurations that may advantageously be employed with the invention. At this initial search stage, switch 64 is positioned to couple elevation servo amplifier 65 to a d.c. source (not shown) and switch 67 is positioned to couple a scanning signal from oscillator circuit 66 to azimuth servo amplifier 68. Thus, antenna 55 is caused to scan in azimuth with a fixed elevation position and the system searches for the target.

During this search period, a range track unit 70 searches and acquires the target in range. This unit may include a discriminator 71 coupled to one terminal of a switch 72, the other terminal of switch 72 is coupled to oscillator circuit 66 and its wiper arm is coupled to the input terminal of an integrator 73, the output terminal of which is coupled to the wiper arm of a switch 74 and to the input terminal of an inverter 75, the output terminal of which is coupled to a sawtooth generator 76 which in turn is coupled to a voltage controlled oscillator (VCO) 77 through a switch 78. The operation of this range track unit is described in detail by Lazarchik et al in U.S. Pat. No. 3,921,169 for a "Multiple Mode Radiometric System with Range Detection Capability", issued Nov. 18, 1975 and assigned to Sperry Rand Corporation. Briefly, prior to range acquisition, switch 72 is positioned to couple a squarewave signal from oscillator circuit 66 to the input terminal of integrator 73. The integrated signal at the output terminal of integrator 73 is coupled to the input terminal of inverter 75 and the inverted signal at the output terminal of inverter 75 is coupled to sawtooth generator 76 which provides a sawtooth signal through switch 78 to frequency modulate VCO 77. This frequency modulated signal is fed to antenna 55 via coupler 81 and circulator 82. Signals radiated by antenna 55 and reflected from the target 16 (FIG. 1) are received by antenna 55 and coupled therefrom through circulator 82 to a mixer/preamp 83, which uses as its local oscillator the frequency modulated signal from VCO 77 which is coupled thereto through coupler 81. The beat frequency caused by the interaction of the delayed (reflected) transmitted frequency modulated signal with the transmitted frequency modulated signal is fed from mixer/preamp 83 to a narrow band amplifier 84 through an IF triplexer 85. When this beat frequency signal is within the bandpass of narrow band amplifier 84, it is amplified therein and fed to detector 86. Upon the achievement of a predetermined signal level at the output terminal of narrow band amplifier 84, detector 86 generates a switching signal through terminal 87 which causes switch 72 to couple the input terminal of integrator 73 to the output terminal of the discriminator 71 and switch 74 to couple the output terminal of integrator 73 to a range detector 88. With this switching accomplished, the discriminator 71 provides an error correcting voltage through integrator 73 and inverter 75 to sawtooth generator 76 thereby adjusting the sweep frequency applied to VCO 77 and maintaining the beat frequency signal generated in mixer/preamp 83 within the bandpass of narrow band amplifier 84. The non-inverted signal at the output terminals of integrator 73 is fed to range detector 88 wherein it is coupled to an active range activator **88*a* whereat at a predetermined range a signal is generated that is coupled through OR gate 90 and terminal 90*a* thereof to active switches 64, 67, and 97 and through terminal 89*a* to activate switch 91. The activation of switches 64, 67 and 91 place the seeker 17 (FIG. 1) in the active mode configuration. The non-inverted signal fed to range detector 88 is also coupled to a passive range activator 88*b* whereat at another predetermined range, a signal is generated at terminal 89*b* and coupled therefrom to activate switches 92 and 78. The activation of switches 78 and 92 place the seeker 17 (FIG. 1) in the passive mode configuration. With switch 78 in the passive position, a constant d.c. voltage is coupled to VCO 77 thereby causing it to oscillate at a fixed frequency which serves as the local oscillator frequency for the mixer/preamp 83 during the passive mode of operation. In the passive mode configuration, emissions received from the target are coupled from the conically scanning antenna 55 to the mixer/preamp 83 wherein the emissions are mixed with the single frequency signal coupled from VCO 77. The IF resulting from this mixing is coupled through triplexer 85 and bandpass amplifier 93 to an IF amplifier 107. The amplified IF signal from IF amplifier 107 is envelope detected by detector 108 and the detected envelope signal is amplified by video amplifier 109 after which the amplified signal is fed to azimuth error detector 61 and to elevation error detector 62 wherein azimuth and elevation error signals are generated which are fed to the azimuth servo amplifier 68 and the elevation servo amplifier 65**, respectively. Active and passive system operations are fully described in the aforementioned U.S. Pat. No. 3,921,169 and will not be further discussed herein.

During the searching period, illuminator signals at frequency $f_1$ are received by antenna 55 and coupled to mixer/preamp 83 through circulator 82. The IF signal resulting from the mixing of this signal with the VCO signal coupled through coupler 81 is fed from triplexer 85 to bandpass amplifier 93 with the signal amplified therein being fed to detector 94 wherein it is detected and fed through blanking gate 95 to acquisition detector 96 and through switches 91 and 92 to an azimuth error detector 61 and elevation error detector 62. The error signal from the azimuth error detector is coupled to a summation network 63 to which a dither signal from oscillator circuit 66 is also coupled with resulting sum being coupled to switch 67. As the seeker approaches the target area, the detected signal level increases as a consequence of the increased illuminator signal received at antenna 55. When the detected signal achieves a predetermined threshold, acquisition detector 96 couples a signal through OR gate 90 and terminal **90*a* thereof to activate switches 64, 67 and 97 causing the output terminal of summation network 63 to be coupled to the azimuth servo amplifier 68, the elevation error detector 62 to be coupled to elevation servo amplifier 65, and the output terminal of a power amplifier 98 to be coupled to a conical scan drive motor 99. This action starts the conical scan drive motor, causing antenna feed horn 57 to conically scan about the boresight axis, and activates the angle tracking loop. Reflected illuminator signals now received by antenna 55 are modulated by the conical scanned antenna beam, amplified in bandpass amplifier 93 and envelope detected in detector 94**.

The detected signals, prior to the activation of switches 91 and 92, are coupled through blanking gate 95 to the azimuth error detector 61 and elevation error detector 62 wherein they are compared with reference signals coupled from terminals 100*a* and 100*b* of position pickoff unit 100 to generate the azimuth and elevation error voltages. The elevation error voltage is then supplied to the elevation servo amplifier while the azimuth error voltage is supplied to the summation network 63 wherefrom the sum of the dither signal and azimuth error signal are coupled to the azimuth servo amplifier. The azimuth error voltage is also supplied to an AGC generator 102 to which is also coupled a reference signal from oscillator circuit 66. AGC signals generated as a result of the signals coupled to AGC generator 102 are coupled from terminal 102*a* to provide AGC action to narrow band amplifier 84, bandpass amplifier 93 and a bandpass amplifier 103.

At any time that the illuminator signal at $f_1$ is received, a possibility exists that a guard signal at $f_2$ may also be received. A guard signal received at antenna 55 is coupled therefrom through circulator 82 to mixer/-preamp 83 wherein the resulting IF frequency is coupled to IF triplexer 85 and therefrom to bandpass amplifier 103 wherefrom it is detected by detector 104 and the detected signal coupled to gate generator 105 and to comparator 106 to which is also coupled the detected output signal from detector 94. The output terminal of comparator 106 is coupled to gate generator 105. If the signal coupled from the guard signal detector 104 is greater than the signal coupled from the illuminator signal detector 94, comparator 106 couples a signal to gate generator 105 and with the signal coupled thereto from detector 104, causes gate generator 105 to couple a signal to blanking gate 95 thereby blanking detected signals resulting from the reception of an illuminator signal from the angle tracking loop. This blanking sequence may also be utilized to eliminate clutter due to ground reflections of signals radiated through the side lobes of the illuminator antenna.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. An air-to-ground terminal guidance system comprising:

tracker-illuminator means for acquiring and tracking a selected ground target and illuminating said selected ground target with signals at a first predetermined frequency;

seeker means external to said tracker-illuminator means for homing on said selected target having therewithin:

means for determining range between said seeker means and said selected target;

means for tracking said selected target through three modes of operation, each mode switchably activated at predetermined ranges from said selected target, said three modes including:

semi-active mode for tracking reflections from said selected target of said first predetermined frequency signal illumination, thereby causing said seeker means to track said selected target for a predetermined initial range;

active mode for tracking reflections from said selected target of a frequency modulated signal emanating from said seeker means which illuminates said selected target, thereby causing said seeker means to track said selected target for a predetermined intermediate range; and passive mode for tracking thermal emissions from said selected target, thereby causing said seeker means to terminally track said selected target;

means for transmitting from said tracker-illuminator means guarding signals at a second predetermined frequency; and means on said seeker means for receiving and processing said guarding signals and said illumination signals to prevent said seeker from tracking said tracker-illuminator means while maintaining said tracking of said reflections from said target of said signal at said first frequency.

2. A guidance system in accordance with claim 1 wherein said tracker-illuminator means includes first antenna means for radiating said illuminating signals and said guarding signals such that the gain of the radiation pattern of said guarding signals is greater than the gain of the radiation pattern of said illuminating signals over all space with the exception of the angular region of the main beam of said illuminating signal radiation pattern, and wherein said illuminating signals are circularly polarized with a predetermined sense and said receptions of said tracker means are circularly polarized with a sense opposite to said predetermined sense.

3. A guidance system in accordance with claim 2 wherein said receiving and processing means includes:

means for detecting said illuminating signal;

means for detecting said guarding signal; and means for comparing the amplitudes of said detected illuminating and guarding signals and for rejecting said illuminating signal whenever said detected guarding signal is of a greater amplitude than said detected illuminating signal.

4. A guidance system in accordance with claim 3 wherein said receiving and processing means includes second antenna means having a boresight axis for receiving said illuminating signals and said guarding signals, said second antenna means cause to scan along a predetermined axis during said semiactive mode until said range means indicates that said seeker means is within a prespecified range to said target, whereafter said second antenna means caused to conically scan about said boresight axis thereby providing azimuth and elevation tracking error signals during said semi-active mode.

5. A guidance system in accordance with claim 2 or 4 wherein said tracker-illuminator means includes:

means coupled to said antenna means for generating said illuminating signal and said guarding signal; and means coupled to said signal generating means for alternately pulsing said illuminating signal and said guarding signal.

6. A guidance system in accordance with claims 2 or 4 wherein said tracker illuminator means includes:

a voltage controlled oscillator;

means for supplying said voltage controlled oscillator alternately with pulses having a first amplitude and a second amplitude, said first amplitude causing said voltage controlled oscillator to oscillate at the frequency of said illuminating signal and said second amplitude causing said voltage controlled oscillator to oscillate at the frequency of said guarding signal; and means coupled to said voltage controlled oscillator, said voltage supply means, and said antenna means, for causing the radiation pattern of said antenna to be said guarding signal radiation pattern when said voltage controlled oscillator oscillates at said frequency of said guarding signal and causing the radiation pattern of said antenna to be said illuminating signal radiation pattern when said voltage controlled oscillator oscillates at said frequency of said illuminating signal.

7. A method for the suppression of clutter received through the side lobes of an antenna which radiates and receives at a first frequency with a first antenna pattern having two way gain characteristics over a main beam angular region and angular regions over all space external to the main beam comprising the steps of:

coupling a signal at said first frequency to said antenna to radiate therefrom;

coupling a signal at a second frequency to said antenna to radiate therefrom with a second antenna pattern which exhibits two way gain characteristics greater than said two way gain characteristics of said first antenna pattern over all space except within said angular region of said main beam;

receiving clutter and target signal reflections at said first and second frequencies;

detecting said received signals at said first and second frequencies to provide first and second detected signal amplitudes, respectively;

comparing said first and second detected signal amplitudes; and blanking said received signal at said first frequency when said detected second signal amplitude is greater than said detected first signal amplitude.

* * * * *